US006512831B1

(12) United States Patent
Herreman et al.

(10) Patent No.: US 6,512,831 B1
(45) Date of Patent: Jan. 28, 2003

(54) NOISE ABATEMENT APPARATUS FOR APPLIANCE CABINET AND METHOD FOR REDUCING NOISE GENERATED BY AN APPLIANCE

(75) Inventors: Kevin M. Herreman, Heath, OH (US); Eric S. Walsh, Newark, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/175,305

(22) Filed: Oct. 20, 1998

Related U.S. Application Data

(60) Provisional application No. 60/065,931, filed on Oct. 21, 1997.

(51) Int. Cl.[7] ..... A61F 11/06; A47B 81/06; G10K 11/04; H02K 5/24; F01N 00/00

(52) U.S. Cl. ..... 381/71.3; 181/198; 181/200; 181/202; 181/204

(58) Field of Search ..... 381/71.3; 181/198, 181/200, 202, 204

(56) References Cited

U.S. PATENT DOCUMENTS

| | | | | |
|---|---|---|---|---|
| 2,254,837 A | | 9/1941 | Burns | |
| 3,557,901 A | * | 1/1971 | Young | 181/31 |
| 3,819,006 A | | 6/1974 | Westlund | |
| 4,007,388 A | | 2/1977 | Lawyer et al. | 310/51 |
| 4,821,839 A | | 4/1989 | D'Antonio et al. | 181/198 |
| 5,056,341 A | | 10/1991 | More et al. | 68/3 |
| 5,110,266 A | * | 5/1992 | Toyoshima et al. | 417/312 |
| 5,151,018 A | * | 9/1992 | Clendenin et al. | 181/202 |
| 5,272,285 A | | 12/1993 | Miller | |
| 5,432,306 A | | 7/1995 | Pfordresher | 181/198 |
| 5,503,172 A | | 4/1996 | Hedeen et al. | 134/183 |
| 5,515,702 A | | 5/1996 | Park | 68/3 |
| 5,965,851 A | * | 10/1999 | Herreman et al. | 181/200 |

FOREIGN PATENT DOCUMENTS

| | | | |
|---|---|---|---|
| EP | 0 718 570 | | 6/1996 |
| JP | 61 246542 | | 3/1987 |
| JP | 03 237961 | | 1/1992 |
| JP | 408049871 A | * | 2/1996 |

* cited by examiner

*Primary Examiner*—Minsun Oh Harvey
*Assistant Examiner*—Elizabeth McChesney
(74) *Attorney, Agent, or Firm*—Inger H. Eckert; Stephen W. Barns

(57) ABSTRACT

Apparatus for reducing noise emitted from an appliance having a cabinet that supports at least one component that emits at least one acoustic pressure wave therefrom. In a preferred form, the apparatus comprises at least one diffuser having at least one deflection surface. The diffuser is coupled to the cabinet and positioned relative to the one component such that the acoustic pressure wave emitted from the component is deflected by the one deflection surface in a predetermined direction. The diffuser can be used to deflect acoustic pressure waves such that they collide with each other. The apparatus may further include at least one absorber. The diffuser is strategically located to deflect acoustic pressure waves being emitted from the component into the absorber to reduce the noise emitted from the appliance.

15 Claims, 8 Drawing Sheets

NOISE ABATEMENT APPARATUS FOR APPLIANCE CABINET AND METHOD FOR REDUCING NOISE GENERATED BY AN APPLIANCE

This application claims the benefit of U.S. Provisional Application No. 60/065,931, filed Oct. 21, 1997, and entitled NOISE ABATEMENT APPARATUS FOR APPLIANCE CABINET AND METHOD FOR REDUCING NOISE GENERATED BY AN APPLIANCE, which is incorporated herein by reference.

TECHNICAL FIELD AND INDUSTRIAL APPLICABILITY OF THE INVENTION

The present invention relates to noise abatement apparatuses and, more particularly, is directed to apparatuses and methods for reducing the emission of noise from an appliance such as an automatic clothes washing machine or a refrigerator.

BACKGROUND OF THE INVENTION

Over the years, many machines have been developed for simplifying household activities and for making such activities less time consuming. For example, the processes and apparatuses used to wash articles of clothing have evolved over the years from the utilization of wash boards and machines equipped with hand powered agitators to the use of electrically powered washing machines having sophisticated washing cycles adapted to accommodate a variety of different clothing materials.

A typical clothes washing machine includes a cabinet that is fashioned from relatively thin metal and typically has an open bottom. A wash basket is rotatably supported within a watertight tub that is located within the cabinet and is adapted to be rotated by an electric motor housed within the cabinet. An access door is provided in the upper surface of the cabinet to provide access to the basket. An agitator is centrally disposed within the basket and is rotatably driven in a back and forth manner to agitate the clothes during various machine cycles. Water is selectively pumped into and drained from the tub at various intervals by a pump mounted within the cabinet. The user typically adds a cleaning medium (e.g., liquid or granular detergents) prior to the commencement of the cleaning cycle.

Most, if not all, commercially available clothes washing machines are equipped with electrical controls that govern various cleaning cycles. For example, after the clothes and detergent have been placed in the basket, a typical first cycle involves the addition of a predetermined amount of water to the tub. The operator can generally select between cold or heated water. After the water has been introduced into the wash tub, an agitating cycle typically begins. Upon completion of the agitating cycle, the water/detergent mixture is drained from the tub. Clean rinse water is then typically added to the tub and the agitation cycle is re-commenced to remove any remaining detergent/dirt from the clothing and tub. Thereafter, the rinse water is drained from the tub. In many clothes washers, the basket is then rapidly spun to assist with the removal of water from the clothing.

Perhaps anyone who is familiar with such washing machines is aware that they tend to generate a large amount of noise throughout their various cycles of operation. The magnitude of such noise can be dependent upon the location of the various machine components such as the pump and motors within the cabinet.

In an effort to reduce the amount of noise emitted from the bottom of the cabinet, shielding plate assemblies have been developed which form an integral portion of the cabinet bottom. Examples of such apparatuses are disclosed in U.S. Pat. No. 5,056,341 and U.S. Pat. No. 5,515,702. Similarly, U.S. Pat. Nos. 4,007,388 and 3,773,140 disclose integral noise reduction systems for large industrial machinery.

Other attempts at noise abatement have involved covering the interior surfaces of the cabinet walls with insulation. However, such methods are not particularly effective and have certain disadvantages. It is known that sound energy is converted to heat when it contacts a porous medium (due to viscous flow losses in the medium). Moreover, such loses tend to be maximized in areas where the velocity of the acoustic wave is maximum. Thus, it is desirable to match the airflow resistance of the absorption material to the velocity of such waves.

When an acoustic pressure wave reaches the interior surface of a cabinet wall, although it has an acoustical pressure, it has little or no velocity. Therefore, less absorption is achieved by the absorption materials that are positioned close to the interior walls of the cabinet. Furthermore, such prior approach of lining the interior surfaces of the cabinet walls requires the use of more absorption materials than would necessarily be required if the location of the absorption materials could be optimized relative to the location/position of the acoustical sound waves. The use of such additional insulation does little to improve the overall noise abatement results and adds significantly to the cost of the appliance. Such approach can also have the undesirable characteristic of retaining heat within the cabinet that could effect the operation of the electrically powered components mounted therein.

Such noise problems are not confined to washing machines. For example, similar problems occur with dishwashers and refrigerators. U.S. Pat. Nos. 4,985,106 and 5,044,705 to Nelson disclose insulation structures that can be employed in connection with dishwashers and water heaters in an effort to reduce the noise emanating therefrom. Such devices are applied to the top and sides of the dishwasher to form acoustical insulation over those portions of the dishwasher.

In view of the problems associated with prior noise abatement methods, there is a need for apparatuses that can be used to optimize the location of acoustical absorption materials within a cabinet enclosure to obtain an acceptable level of noise abatement while minimizing the amount of absorption material required.

There is another need for apparatus to advantageously alter the interior of a cabinet or enclosure that houses components that emit acoustical pressure waves to optimize the location of acoustical absorption materials within the cabinet.

There is yet another need for apparatus that is relatively inexpensive to produce, install and maintain for reducing the transmission of noise generated by an appliance such as an automatic clothes washing machine or a refrigerator.

There is still another need for apparatus that can be applied to a centrally located component of a machine that optimizes the amount of acoustical absorption while providing a desirable amount of localized thermal insulation thereto without retaining an undesirable amount of heat in the portions of the cabinet that house heat sensitive components.

SUMMARY OF THE INVENTION

In accordance with a particular preferred form of the present invention, there is provided an apparatus for reducing noise emitted from an appliance having a cabinet that supports one or more components that emit acoustic pressure waves. In a preferred form, the apparatus comprises a diffuser sized for placement within the cabinet or coupled to an outer portion of the cabinet. The diffuser has at least one deflection surface such that when the diffuser is coupled to the cabinet and located relative to at least one component, at least one deflection surface deflects at least one acoustical wave in a predetermined direction. In other preferred embodiments, the diffuser(s) are used in connection with absorber(s) coupled to the cabinet such that the diffuser(s) deflect acoustic pressure waves emitted from the component (s) into the absorber(s) wherein they are substantially absorbed.

The subject invention also preferably comprises a method for reducing the noise emitted by an appliance having a cabinet that supports at least one component that emits at least one acoustic pressure wave therefrom. Such method preferably comprises the actions of providing at least one absorber and positioning at least one diffuser relative to the component and the absorber to deflect at least one acoustic pressure wave to the absorber.

The subject invention also comprises a method of altering the internal geometry of an appliance cabinet that supports at least one component that emits at least one acoustic pressure wave. Such method preferably comprises the actions of coupling at least one absorber and at least one diffuser to the cabinet. The diffuser is preferably positioned relative to the component and the absorber such that the diffuser deflects at least one acoustic pressure wave to the absorber.

The present invention represents a unique and novel method and apparatus for reducing noise that is emitted from an appliance such as a washing machine or a refrigerator. The apparatus is relatively easy and inexpensive to manufacture and install and, as will be discussed in further detail below results in the reduction of emitted noise. These and other details, objects and advantages will become apparent as the following detailed description of the present preferred embodiments proceeds.

BRIEF DESCRIPTION OF THE DRAWINGS

In the accompanying drawings, there are shown present preferred embodiments of the invention wherein like reference numerals are employed to designate like parts and wherein.

DETAILED DESCRIPTION OF THE PREFERRED EMBODIMENTS

Figure 1:
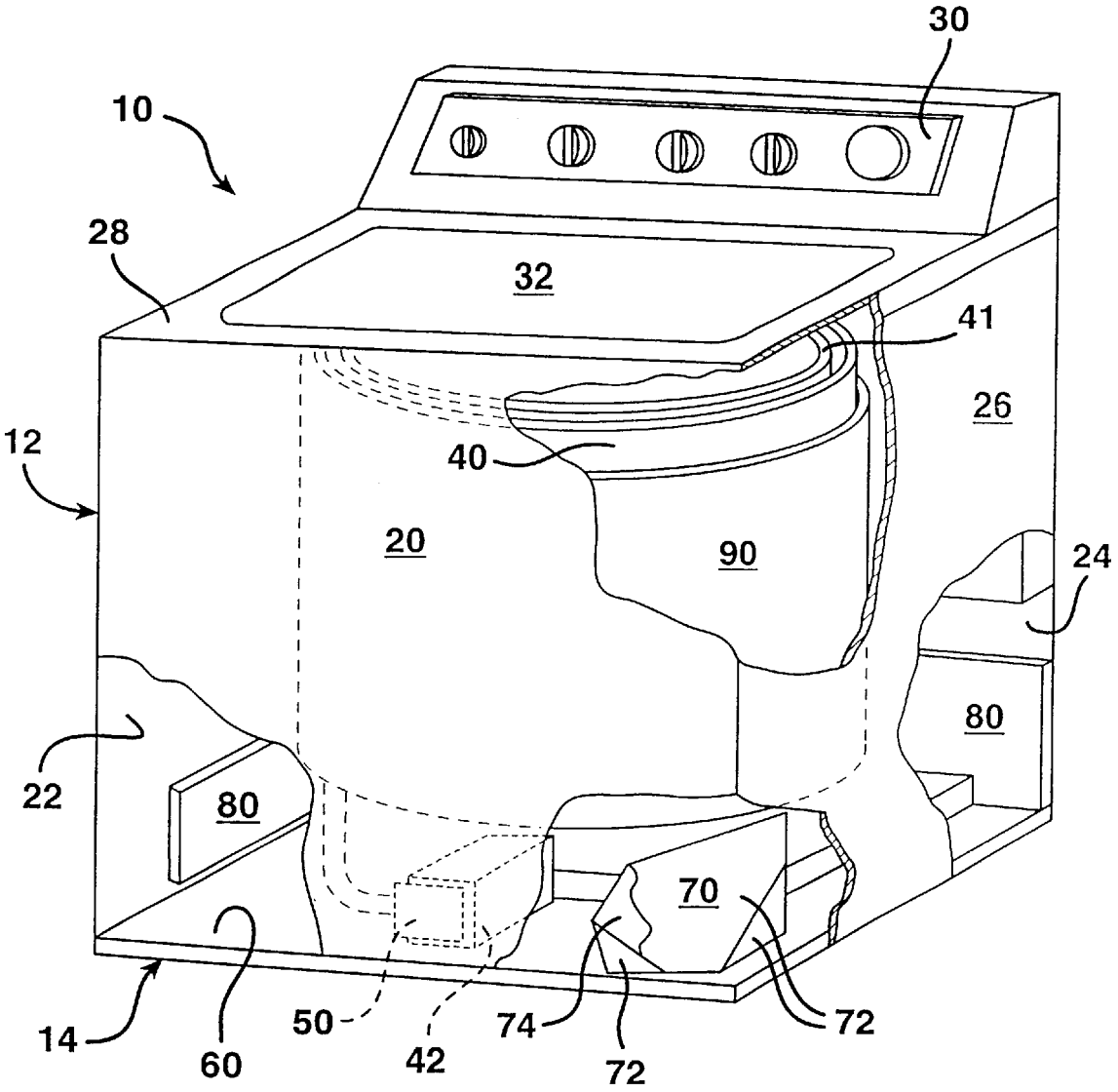
FIG. 1 is an isometric view of preferred apparatus of the present invention installed within an automatic washing machine.

Referring now to the drawings for the purposes of illustrating present preferred embodiments of the invention only and not for purposes of limiting the same, the Figures show preferred apparatuses for reducing the transfer of noise generated by an appliance such as a washing appliance or a refrigerator. As used herein, the phrase "washing appliance" refers to a clothes washing machine. However, as the present Detailed Description continues, the skilled artisan will appreciate that the subject invention can be used in connection with a variety of different apparatuses that have a cabinet or enclosure that supports at least one component that emits an acoustical pressure wave such as dishwashers, etc. Thus, the scope of protection afforded to the subject invention should not be limited to use in connection with clothes washing machines or refrigerators.

More particularly and with reference to FIG. 1, there is shown a washing appliance 10 that has a cabinet 12 that has an opened bottom 14. The cabinet 12 has four vertically extending side walls (20, 22, 24, 26) and a upper surface 28. A control panel 30 is mounted on the top portion of the cabinet 12 and an access door 32 is provided through the upper surface 28 to enable articles of clothing to be placed into the machine. The cabinet depicted in FIG. 1 and described herein is exemplary of cabinets used in connection with commercially available washing machines and is generally fabricated from metal. Those of ordinary skill in the art will appreciate, however, that cabinet 12 could be fabricated in a variety of different shapes and configurations from various other materials.

The washing machine depicted in FIG. 1 is provided with a tub 40 that is suspended within the cabinet. The tub has a basket 41 therein for receiving the items to be washed. The skilled artisan will appreciate that the basket 41 is provided with an agitator of the type known in the art (not shown). The basket 41 is rotated by a motor 42 located within the cabinet 12. Hot and cold water is generally admitted into the tub 40 through supply lines connected to the residence's water lines. An electrically controlled solenoid valve is mounted in the supply line to permit water to be selectively added to the tub 40. To drain the water from the tub, a pump 50 is mounted within the cabinet 12 and is adapted to pump water from the tub 40 to a drain.

In a preferred embodiment, a sound absorbing pad or "bottom board" 60 is placed on the floor directly below the cabinet 12 within the area circumscribed by the walls (20, 22, 24, 26). Preferably, pad 60 comprises a glass fiber mat encased in a polyethylene bag. Preferably, the mat is a nonwoven mat formed of glass fibers of a mean diameter of from about 6 to 7 microns. The bag is preferably thin enough to permit penetration of acoustic energy to the mat and is preferably sealed to exclude debris such as laundry detergent, bleach and other items that could adversely affect the glass fiber mat. Also, to reflect acoustical pressure waves emitted from the various machine components such as the motor 42, pump 50 and agitator to predetermined locations within the cabinet, at least one diffuser member 70 is preferably employed.

Diffuser member 70 is preferably fabricated from a commercially available resonated fiberglass material. In a preferred embodiment, the diffuser material comprises ⅛ inch to ¼ inch thick high density resonated fiberglass having a preferred density of fifteen pounds per cubic foot; however, other low mass, high-stiffness materials having similar densities could also be successfully employed, such as a suitable foam material. As will be discussed in further detail below, diffuser member 70 can be provided in a myriad of geometric shapes that provide deflection surfaces 72 such that when the diffuser member 70 is properly oriented relative to a component and an absorption medium, the acoustical pressure waves emitted therefrom are reflected off of the deflection surfaces 72. Also in a preferred embodiment, a commercially available foil facing 74 is applied to the deflection surfaces 72 of the diffuser 70 to enhance the diffuser's ability to reflect acoustic pressure waves. In addition, depending upon the number of acoustical pressure waves and their orientations and magnitudes and depending upon the number, orientation and geometric shape of the diffusers 70 employed, one or more commercially available acoustical absorber panels 80 are affixed to the interior surfaces of the cabinet walls (20, 22, 24, 26). A preferred acoustical absorber panel 80 comprises a fiberglass or porous foam media having a density of at least 1.0 pounds per cubic foot, and more preferably of about 1.7 pounds per cubic foot and a thickness of about one inch; however, other commercially available acoustical absorption panels could be successfully employed.

A preferred method for utilizing the preferred diffuser members 70 of the present invention will now be described. First, available modeling techniques are used to determine the orientation and magnitude of the acoustical pressure waves produced within the cabinet. Utilizing this information, the skilled artisan can then determine where to locate the diffuser(s) 70 and absorption panel(s) 80 within the cabinet 12. Such information can also be utilized to determine the most advantageous geometric shape of the diffuser(s) 70. For example, depending upon the orientation of the acoustical pressure waves, a diffuser 70 could be fabricated with multiple reflection surfaces that serve to reflect multiple acoustical pressure waves to locations within the cabinet 12 where they can be absorbed by absorption panels 80 strategically located within the cabinet 12. Those of ordinary skill in the art will also appreciate that desirable noise abatement can be achieved by reflecting acoustical pressure waves such that they collide with each other to reduce their velocities and pressures. After the optimum positions for the diffuser(s) 70 and absorption panel(s) 80 have been determined, the diffuser(s) 70 can be affixed to the cabinet walls, legs, bottom panel, etc., by known fastening techniques (i.e., adhesives or other mechanical fasteners).

Figure 2:
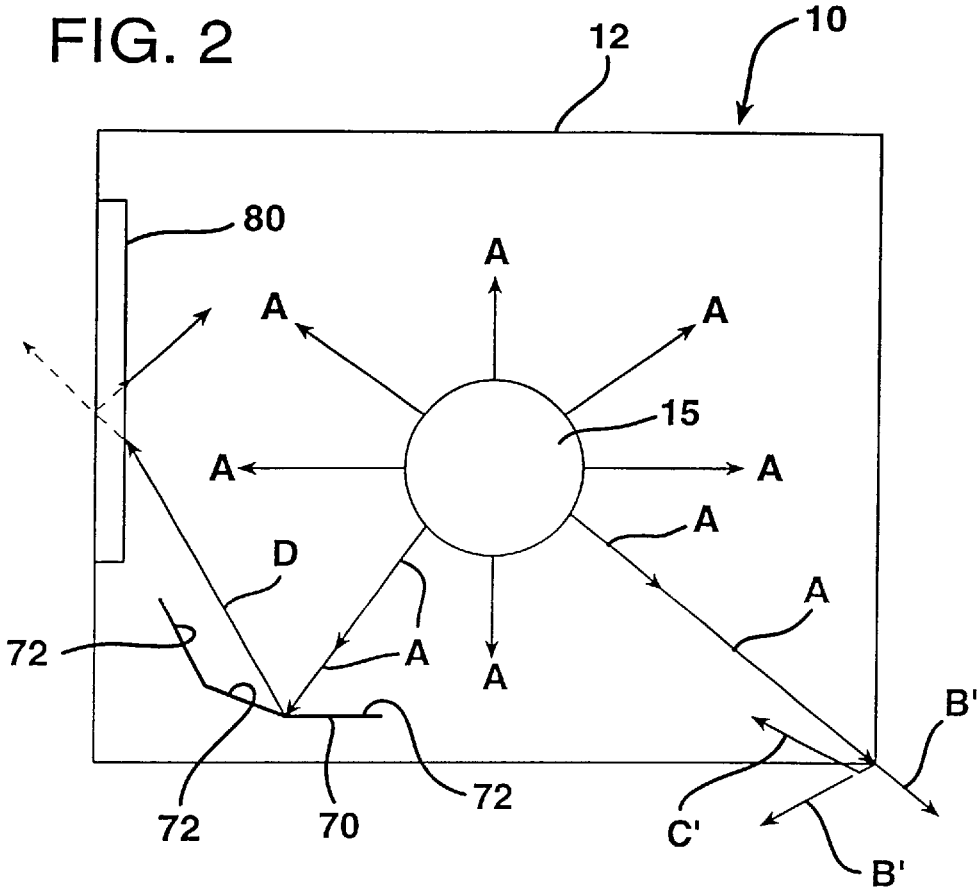
FIG. 2 is a schematic representation of the cabinet of a washing machine that illustrates a preferred arrangement of a preferred diffuser of the present invention.
Figure 3:
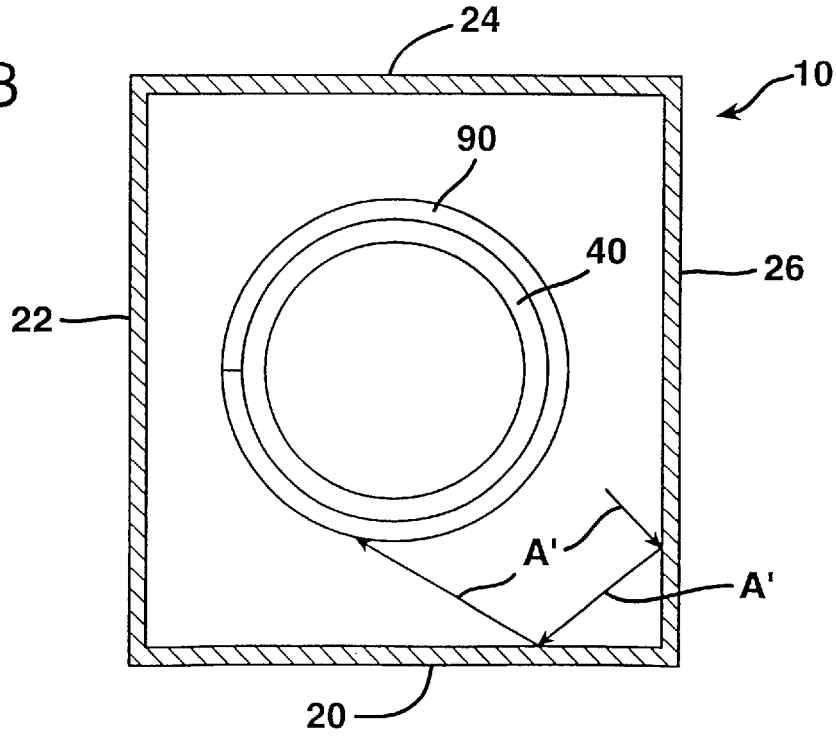
FIG. 3 is a plan view of a preferred tub wrap of the present invention attached to the wash tub of a washing machine.

By way of example only, FIG. 2 is a schematic depiction that illustrates the use and effect of a preferred diffuser 70 of the present invention within a washing machine cabinet 12. As shown in FIG. 2, the cabinet 12 of the washing machine 10 is treated as an enclosure with a noise generating source inside (generally indicated as 15). The geometry of the enclosure (cabinet 12) is illustrated as a box with dimensions similar to those of most commercially available washing machine cabinets. The source 15 is treated as a vertically oriented cylindrical member that is located in the center of the cabinet 12. The source 15 radiates sound energy (represented by arrows "A") in horizontal planes toward the sides of the cabinet 12. Without a preferred diffuser 70 of the present invention, as the pressure waves strike the sides of the cabinet 12, some of the energy is transmitted through the cabinet walls (represented by arrows "B") and some of the energy is reflected back into the cabinet (represented by arrows "C"). By strategically placing the diffuser 70 and absorber 80 within the cabinet, the energy that strikes the diffuser 70 (represented by arrows "D") is reflected away from the front of the cabinet 12 and towards the absorber 80. Along the path towards the absorber 80, the pressure wave can also interact with other pressure waves which reduces the amplitudes of such interacting waves. When a reduced wave interacts with the absorber 80, it is along a much longer path than would be the case with normal incidence waves (i.e., non-deflected waves). Using simple geometric principles, skilled artisan can calculate the preferred angles of the diffuser surfaces 72.

The following chart illustrates the noise abatement achieved when employing the above-mentioned apparatuses and techniques in connection with a commercially available washing machine Model No. 11026932691 manufactured by Whirlpool Corporation of Benton Harbor, Mich., U.S.A. The first line of the chart provides the package sound power levels (in dBA) emitted by an unaltered machine during the agitation and spin cycles. The second line of the chart provides the package sound power levels when side absorption panels ("SA") and a rudimentary metal flange (referred to in the chart as "Flange") was employed as a diffuser to reflect acoustical pressure waves. The flange was located approximately six inches from the right and left front corners. Line three of the chart sets forth the package sound power levels when two of the preferred diffusers of the present invention (referred to in portions of the chart as "DF") were located at a vertical thirty degree angle from the left and right front corners and a forty five degree angle from the front panel of the cabinet. The fourth line of the chart sets for the package sound levels for the preferred diffusers, side absorption panels and a preferred tub wrap (referred to in the chart as "TW") as will be discussed in further detail below. The last line of the chart sets forth the sound package sound power levels when the preferred diffusers, sound absorbers, tub wrap and rear absorbers were employed.

| | Package Sound Power Levels | |
|---|---|---|
| Treatment Type | Agitate (dBA) | Spin (dBA) |
| Unit As Received | 65.5 | 66.8 |
| Side Absorption + Flange | 63.7 | 64.8 |
| Diffusers | 63.9 | 64.3 |
| DF and Side Abs and Tub Wrap | 62.0 | 63.9 |
| DF SA TW Rear Abs | 61.6 | 62.9 |

The following chart sets forth the percent reduction in loudness (utilizing the Stevens test method) when compared to an untreated machine:

| | Percent Reduction in Stevens (ISO 532A) Loudness Versus current Sound Pack | |
|---|---|---|
| Treatment Type | Agitate (%) | Spin (%) |
| Side Abs + Flange | 14.5 | 12.7 |
| Diffusers | 22.1 | 9.4 |

-continued

| Treatment Type | Percent Reduction in Stevens (ISO 532A) Loudness Versus current Sound Pack | |
|---|---|---|
| | Agitate (%) | Spin (%) |
| DF and Side Abs and Tub Wrap | 24.3 | 15.6 |
| DF SA TW Rear Abs | 24.0 | 9.0 |

The following chart sets forth the percent reduction in loudness (utilizing the Zwicker test method) when compared to an untreated machine:

| Treatment Type | Percent Reduction in Zwicker (ISO 532B) Loudness versus Current Sound Pack | |
|---|---|---|
| | Agitate (%) | Spin (%) |
| Side Abs + Flange | 14.4 | 13.5 |
| Diffusers | 15.3 | 11.5 |
| DF and Side Abs and Tub Wrap | 23.9 | 14.5 |
| DF SA TW Rear Abs | 25.8 | 20.4 |

As can be seen from the forgoing charts, utilizing the diffuser members of the present invention in connection with various absorption panels can greatly reduce the amount of noise emitted from a washing machine or any machine that has components that emit acoustical pressure waves within an enclosure.

As discussed above, when the various unreflected acoustical pressure waves contact the side walls of the cabinet, their velocities are believed to essentially be zero, which reduces the effectiveness of the absorption panels affixed to the cabinet walls. However, it has been discovered that, by affixing absorption material around the outer periphery of the tub 40, two significant advantages can be obtained. First, because the acoustical pressure waves have a greater velocity away from the side walls of the machine (i.e., around the tub 40) those pressure waves can be more effectively absorbed by placing absorption material around the tub 40 and thus matching the airflow resistance of the absorption material with the velocities of the pressure waves. Thus, in a preferred embodiment as depicted in FIGS. 1 and 2, a tub wrap 90, preferably fabricated from approximately one inch thick fiberglass having a density of one pound per cubic foot that is enclosed in a polyethylene bag, is wrapped around the outer periphery of the tub and preferably affixed thereto by a commercially available urethane based adhesive. As can also be seen in FIG. 2, the acoustical pressure waves (represented by arrows "A")can reflect off of the walls (20, 22, 24, 26) of the cabinet 12 and be absorbed by the wrap 90.

The second important advantage provided by the preferred tub wrap 90 of the present invention is that it thermally insulates the tub 40 making the machine more energy efficient. Furthermore, when hot water is admitted to the tub, the tub wrap 90 retards the dissipation of heat into the cabinet interior wherein it could hamper the operation of the electrical components (i.e., motor 42 and pump 50).

Figure 7:
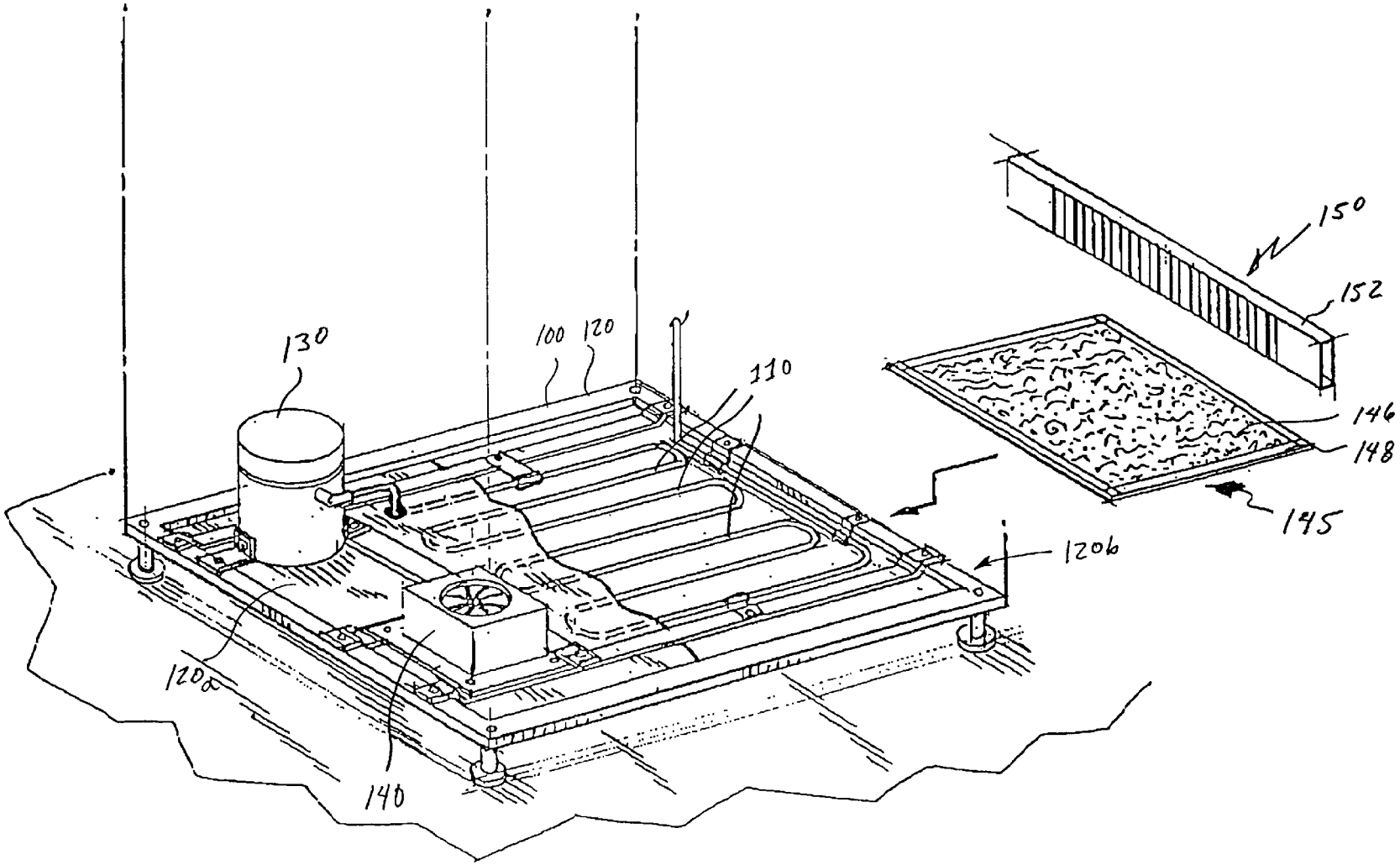
FIG. 7 is an exploded, perspective view of a bottom portion of a refrigerator with the side walls removed and the bottom wall partially removed and including the diffuser illustrated in FIG. 4.
Figure 8:
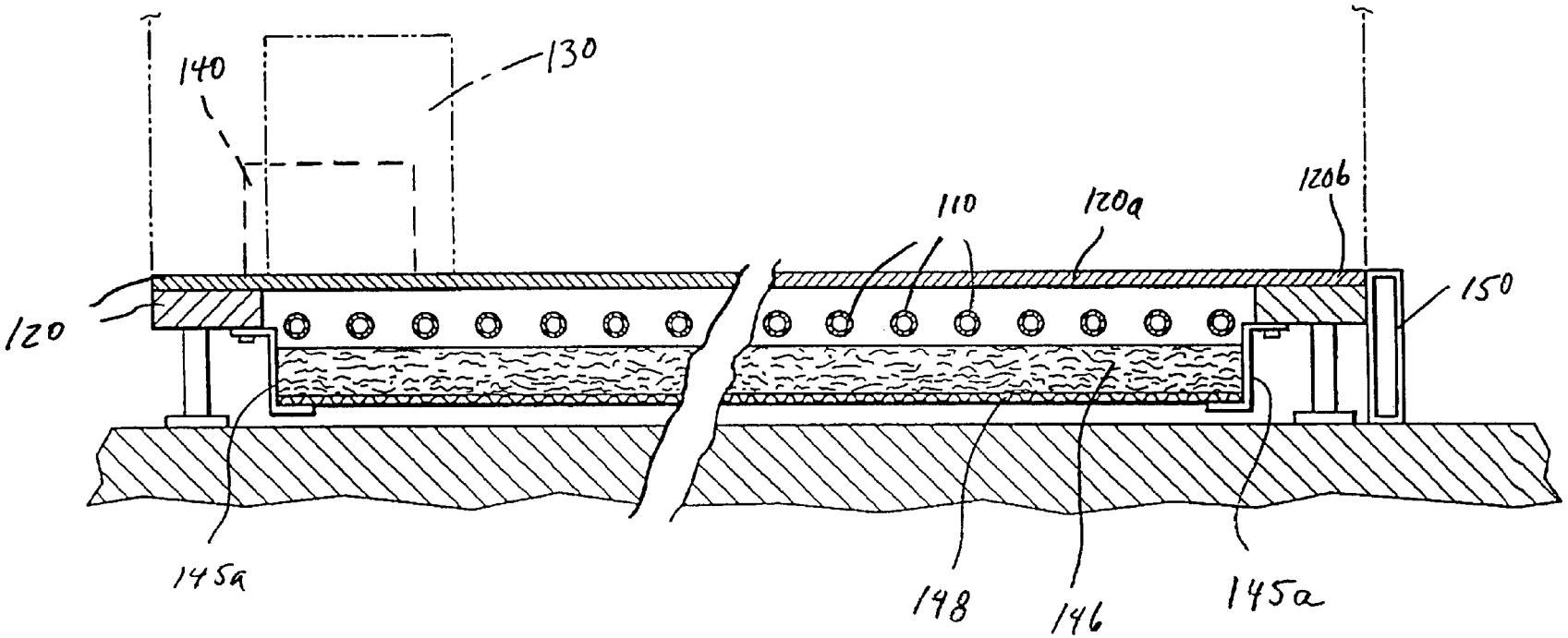
FIG. 8 is a side view, partially in cross section, of the bottom portion of the refrigerator illustrated in FIG. 7.

Referring now to FIGS. 7 and 8, there is shown a refrigerator 100 including a cabinet 120 having four vertically extending side walls (not shown), a bottom wall 120*a* and a top wall (not shown). Condenser coils 110 are coupled to the cabinet bottom wall 120*a* by conventional fasteners (not shown). Also illustrated in FIGS. 7 and 8 are a compressor 130 and a fan 140, both coupled to and supported by the cabinet 120. The compressor 130 and the fan 140 are sources of acoustical pressure waves.

An acoustical absorber panel 145 is attached to the bottom wall 120*a* of the cabinet 120 such as by conventional retainers 145*a*, see FIG. 8. The absorber panel 145 may comprise polyester fiber material 146 laminated to a hardboard sheet 148. The hardboard sheet 148 can comprise a flame retardant paperboard, such as one having a thickness of about 0.06 inch and a density of 32 pounds/ft$^3$. Such a sheet is commercially available from Lydall Composite Materials, Covington, Tenn. The panel 145 may also be formed from other sound absorbing materials, such as those discussed above from which panel 80 is constructed.

Figure 4:
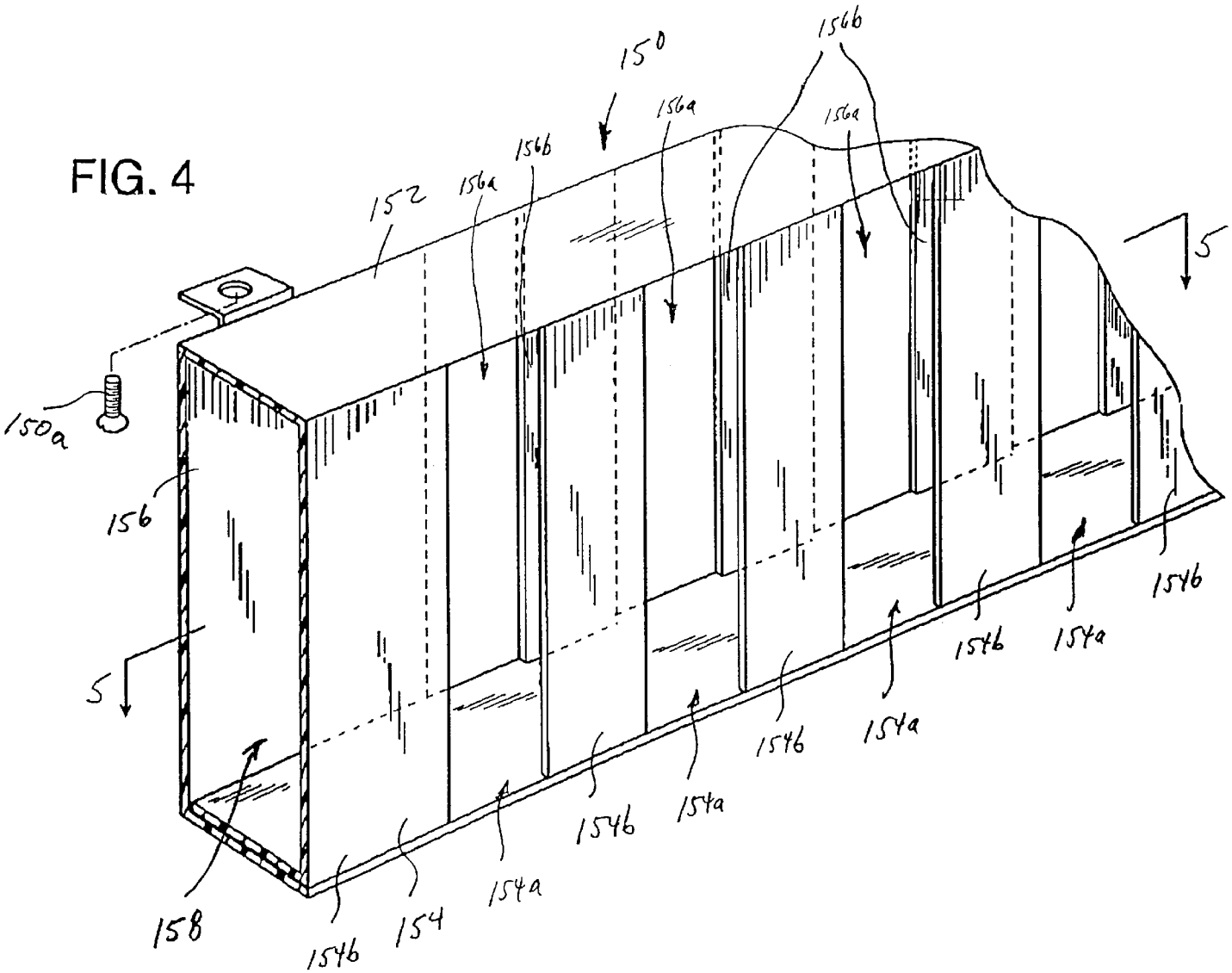
FIG. 4 is a perspective view of a diffuser constructed in accordance with a second embodiment of the present invention.
Figure 6:
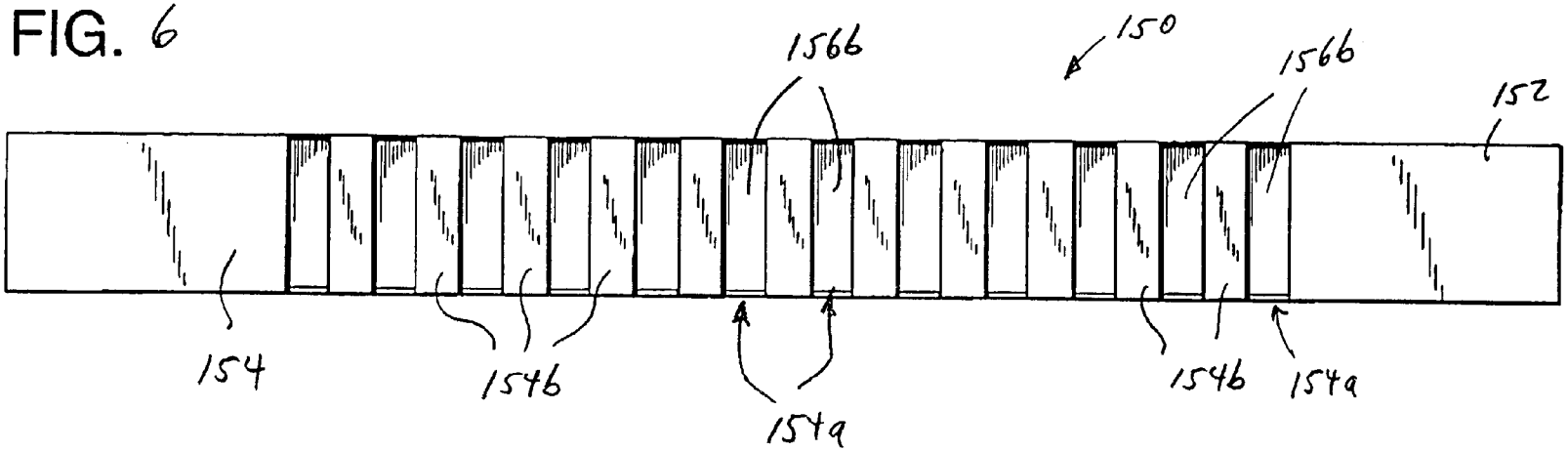
FIG. 6 is a side view of the diffuser illustrated in FIG. 4.
Figure 5:
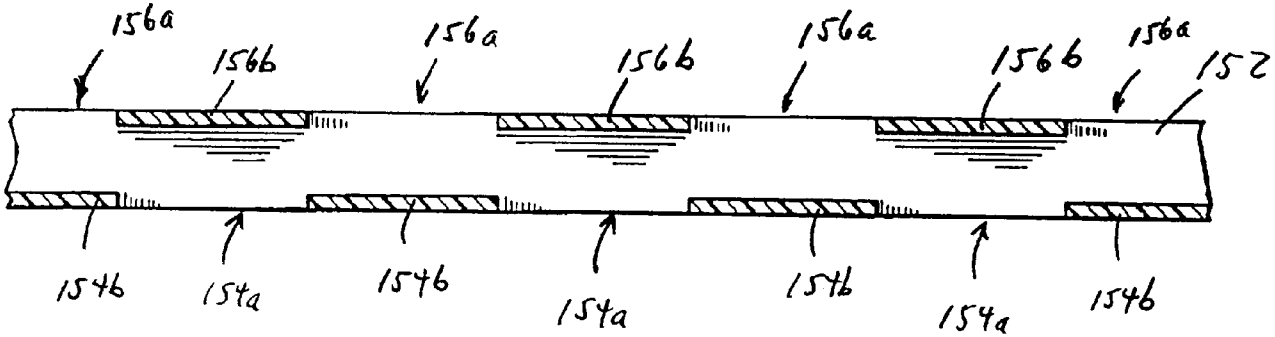
FIG. 5 is a view taken along view line 5—5in FIG. 4.

A diffuser 150 is coupled to a front portion 120*b* of the bottom wall 120*a* of the cabinet 120 by conventional fasteners 150*a*, see FIG. 4. It comprises a body 152, see FIGS. 4–6, formed from a polymeric material such as polypropylene, polyethylene, polycarbonate, polystyrene, or a like material. It can also be formed from other materials, such as cardboard. The body 152 has first and second generally parallel walls 154 and 156 separated from one another by an open channel 158. The first wall 154 has a plurality of alternating open and closed first portions 154*a* and 154*b* and the second wall 156 has a plurality of alternating open and closed second portions 156*a* and 156*b*. The closed first and second portions 154*b* and 156*b* are generally planar in shape. The open first portions 154*a* are generally aligned with the closed second portions 156*b* and the closed first portions 154*b* are generally aligned with the open second portions 156*a*. Due to this arrangement of open and closed portions in the first and second walls 154 and 156, air, which is moved by the fan 140, is permitted to pass through the diffuser 150 while acoustical pressure waves generated by the compressor 130 and the fan 140 are deflected or reflected back toward the acoustical absorber panel 145 where they are substantially absorbed.

It is also contemplated that the diffuser 150 can be formed as an integral part of a refrigerator front grill or cover (not shown).

Figure 9:
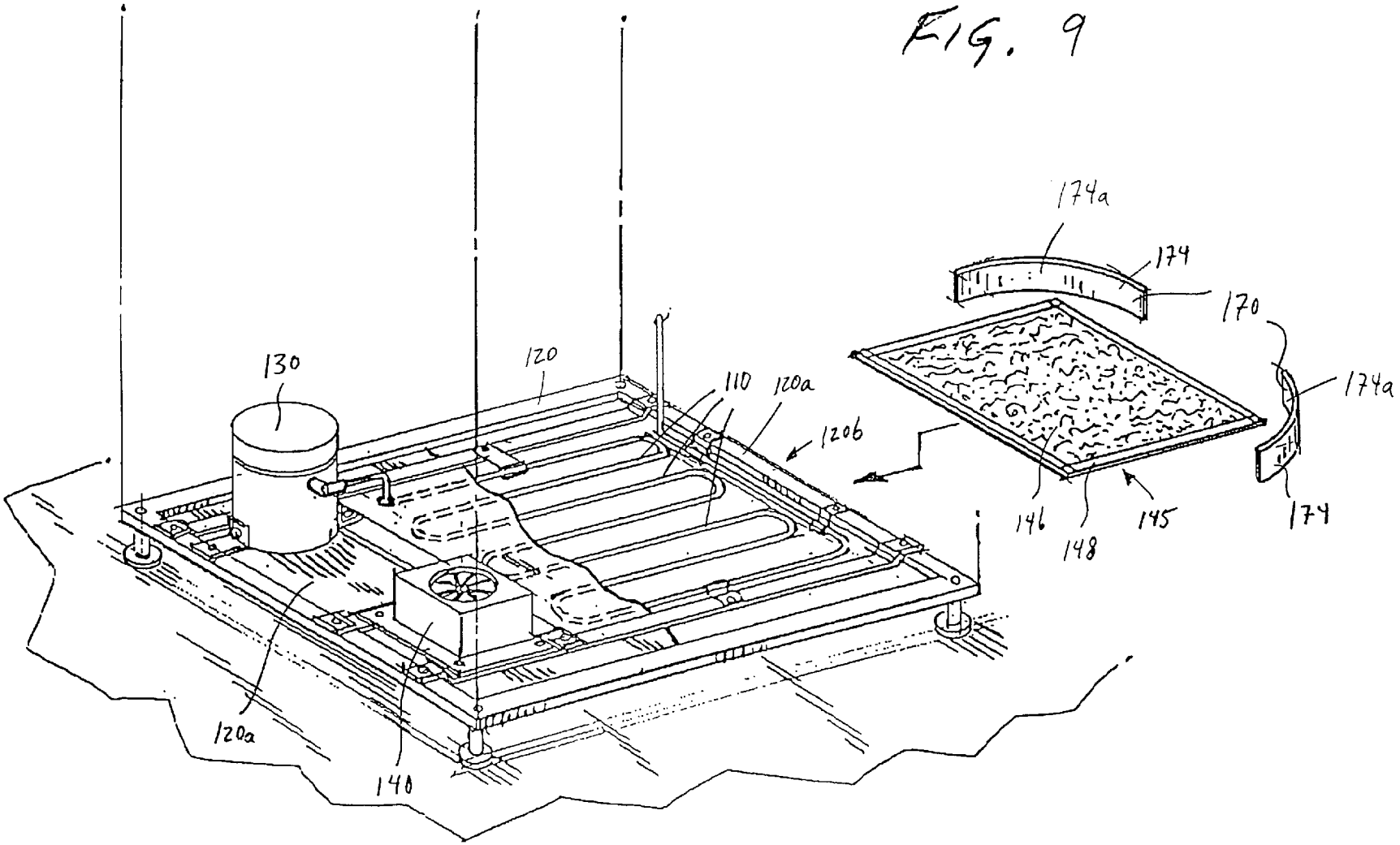
FIG. 9 is an exploded, perspective view of a bottom portion of a refrigerator with the side walls removed and the bottom wall partially removed and including a pair of diffusers constructed in accordance with a third embodiment of the present invention.
Figure 10:
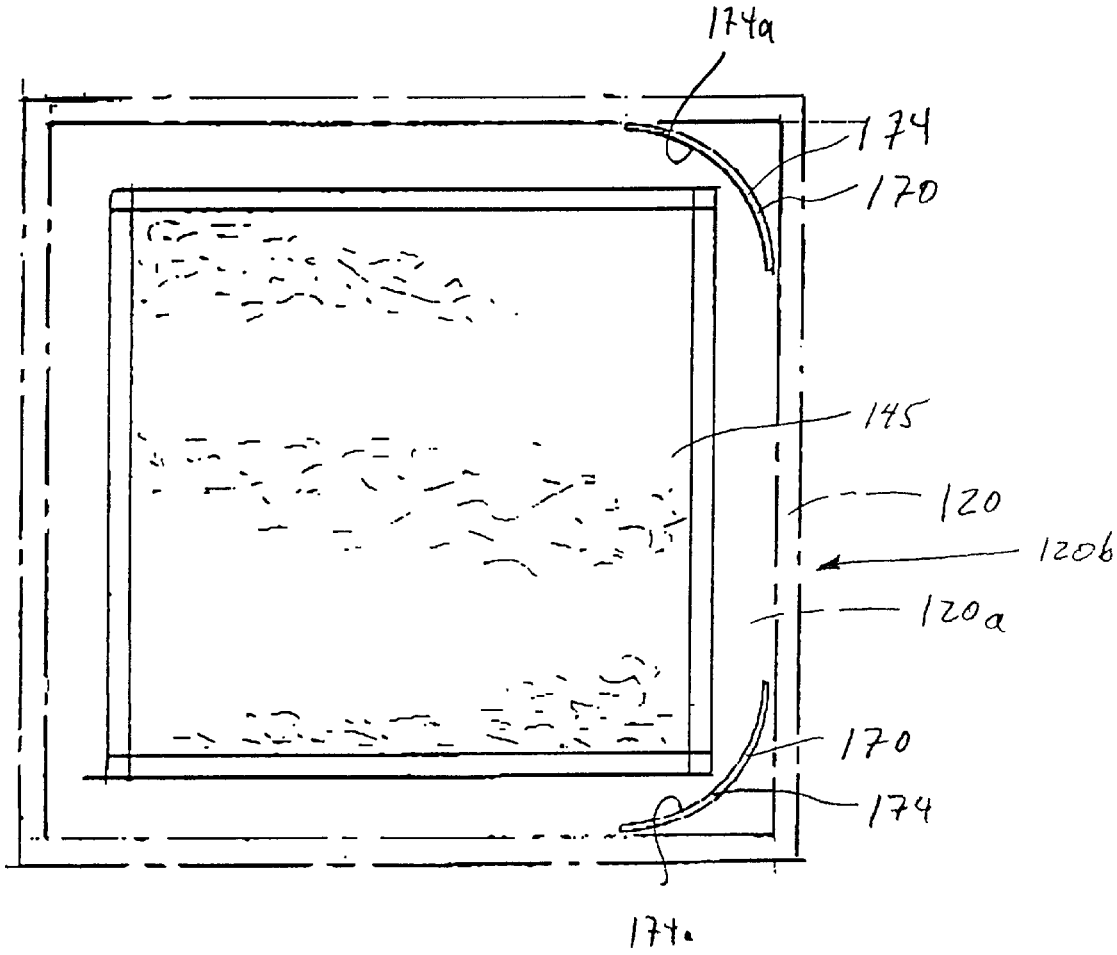
FIG. 10 is a view of the underside of the refrigerator illustrated in FIG. 9.

A pair of diffusers 170, constructed in accordance with third embodiment of the present invention, are illustrated in FIGS. 9 and 10, wherein like reference numerals indicate like elements. The two diffusers 170 are coupled to opposite corners of the front portion 120*b* of the bottom wall 120*a* of the cabinet 120 by conventional fasteners (not shown). Each diffuser 170 comprises a body 174 formed from a polymeric material such as polypropylene, polyethylene, polycarbonate, polystyrene, or a like material. They can also be formed from other materials, such as hardboard. The diffusers 170 have a generally curved shape and include a deflection surface 174*a*. Because the diffusers 170 are positioned substantially in line with the compressor 130 and the fan 140, they deflect or reflect a significant portion of the acoustical pressure waves generated by those elements back toward the acoustical absorber panel 145 where they are substantially absorbed.

The following chart illustrates the noise abatement achieved when the absorber panel 145 and diffusers 150 and 170 illustrated in FIGS. 4–10 were coupled to a commercially available refrigerator Model No. FRS26ZRFW3 manufactured by Frigidaire. The first line of the chart provides the sound power level (in dBA) emitted by the refrigerator before an absorber panel and a diffuser were coupled thereto. The second line of the chart provides the sound power level (in dBA) emitted by the refrigerator when only an absorber panel was coupled to the bottom wall of the refrigerator. The absorber panel comprised polyester fiber material laminated to a hardboard sheet and was sized so as to fill the area below the condenser coils. The third line of the chart provides the sound power level (in dBA) emitted by the refrigerator when an absorber panel and diffuser, such as the one illustrated in FIGS. 4 and 5, were coupled to the bottom wall of the refrigerator. The fourth line of the chart provides the sound power level (in dBA) emitted by the refrigerator when an absorber panel and a pair of diffusers, such as those illustrated in FIG. 6, were coupled to the bottom wall of the refrigerator.

| Treatment Type | Package Sound Power Levels During Normal Operation A-weighted SPL (dBA) |
|---|---|
| Unit as Received | 31.38 |
| Absorber Panel Only | 25.06 |
| Diffuser 150 + Absorber Panel | 23.42 |
| Diffusion 170 + Absorber Panel | 22.69 |

The following chart sets forth the percent reduction in loudness (utilizing the Stevens test method) when compared to the unit as received and before modification:

| Treatment Type | Percent Reduction in Stevens (ISO 532A) Loudness Versus Unit As Received at 1000–4000 Hz During Normal Operation (%) |
|---|---|
| Absorber Panel Only | 73.1 |
| Diffuser 150 + Absorber Panel | 84.9 |
| Diffusion 170 + Absorber Panel | 93.5 |

The following chart sets forth the percent reduction in loudness (utilizing the Zwicker test method) when compared to the unit as received and before modification:

| Treatment Type | Percent Reduction in Zwicker (ISO 532B) Loudness Versus Unit As Received at 1000–4000 Hz During Normal Operation (%) |
|---|---|
| Absorber Panel Only | 46.5 |
| Diffuser 150 + Absorber Panel | 53.5 |
| Diffusion 170 + Absorber Panel | 56.1 |

As can be seen from the forgoing charts, utilizing the diffuser members of the present invention in connection with an absorber panel can greatly reduce the amount of noise emitted from a refrigerator or any machine that has components that emit acoustical pressure waves.

As can be appreciated from foregoing descriptions, the preferred embodiments of the present invention present an economical way to reduce the amount of noise emitted from an appliance or a machine that has a cabinet that houses at least one component that emits at least one acoustical pressure wave. The subject invention can also be used to reduce the amount of noise emitted by a machine that has a cabinet and a component centrally located away from the cabinet walls to which a sound absorption medium can be advantageously attached. Accordingly, the present invention provides solutions to the problems associated with prior noise reduction apparatuses and methods employed for reducing the noise emitted by washing appliances, refrigerators and other machines. It will be further understood, however, that various changes in the details, materials and arrangements of parts which have been herein described and illustrated in order to explain the nature of the invention may be made by those skilled in the art within the principle and scope of the invention as expressed in the appended claims.

What is claimed is:

1. Apparatus for reducing noise emitted by an appliance having a cabinet that houses one or more components that emit two or more acoustical pressure waves, said apparatus comprising at least one diffuser sized for placement within said cabinet, said at least one diffuser having at least one deflection surface thereon for deflecting at least one acoustical pressure wave in a predetermined direction;

wherein at least one said deflection surface on at said at least one diffuser deflects at least one acoustical pressure wave such that said deflected acoustical pressure wave collides with at least one other acoustical pressure wave.

2. The apparatus of claim 1 wherein each said diffuser is fabricated from resonated fiberglass having a density of fifteen pounds per cubic foot.

3. Apparatus for reducing noise emitted by an appliance having a cabinet supporting at least one component that emits at least one acoustic pressure wave therefrom, said apparatus comprising:

at least one absorber coupled to an outer surface of said cabinet; and at least one diffuser coupled to an outer surface of said cabinet and positioned relative to at least one component and said at least one absorber such that said at least one diffuser deflects said at least one said acoustic pressure wave to said at least one absorber to thereby reduce said noise emitted by said appliance.

4. The apparatus of claim 3 wherein each said absorber comprises a fiberglass material having a density of at least one pound per cubic foot.

5. The apparatus of claim 3 wherein each said absorber comprises a porous foam having a density of at least one pound per cubic foot.

6. The apparatus of claim 3 wherein each said diffuser is fabricated from resonated fiberglass having a density of fifteen pounds per cubic foot.

7. The apparatus of claim 3 wherein said cabinet has an open bottom and wherein one of said absorbers encloses said bottom of said cabinet.

8. The apparatus of claim 3 wherein said appliance has a wash tub and wherein one of said absorbers comprises fiberglass having a density of approximately one pound per cubic foot affixed to said tub.

9. The apparatus of claim 3, wherein said at least one diffuser comprises a pair of curvilinear diffusers.

10. The apparatus of claim 3, wherein said at least one diffuser comprises an element having first and second generally parallel walls, said first wall having a plurality of alternating open and closed first portions and said second wall having a plurality of alternating open and closed second portions, said open first portions being generally aligned with said closed second portions and said closed first portions being generally aligned with said open second portions.

11. A method for reducing noise emitted from an appliance having a cabinet that supports at least one component that emits at least one acoustic pressure wave therefrom in a direction and at least one absorber coupled to an outer surface of said cabinet, said method comprising the steps of:

determining the direction of said at least one acoustic pressure wave; and coupling at least one diffuser to an outer surface of said cabinet such that it is positioned relative to the direction of said at least one acoustic pressure wave and said at least one absorber, said diffuser directing said acoustic pressure wave toward said absorber.

12. The method of claim 11, wherein said appliance comprises a washing machine.

13. The method of claim 11, wherein said appliance comprises a refrigerator.

14. A method for altering the geometry of an appliance cabinet that supports at least one component that emits at least one acoustic pressure wave therefrom to reduce the noise emitted from said cabinet, said method comprising the steps of:

coupling at least one absorber to an outer surface of said cabinet; and coupling at least one diffuser to an outer surface of said cabinet such that it is positioned relative to said component and said absorber, said diffuser deflecting said at least one acoustic pressure wave to said at least one absorber to thereby reduce noise emitted from said appliance.

15. The method of claim 14 wherein each said absorber comprises fiberglass having a density of approximately one pound per cubic foot.

* * * * *